US008015121B2

(12) United States Patent
Gilham

(10) Patent No.: US 8,015,121 B2
(45) Date of Patent: Sep. 6, 2011

(54) SYSTEM FOR FRANKING MAIL ITEMS WITH DATA DOCUMENT OR FILE ASSOCIATED THEREWITH

(75) Inventor: Denis Gilham, Stock (GB)

(73) Assignee: Neopost Industrie, Bagneux (FR)

( * ) Notice: Subject to any disclaimer, the term of this patent is extended or adjusted under 35 U.S.C. 154(b) by 1641 days.

(21) Appl. No.: 10/352,080

(22) Filed: Jan. 28, 2003

(65) Prior Publication Data

US 2003/0167241 A1 Sep. 4, 2003

(30) Foreign Application Priority Data

Jan. 29, 2002 (FR) ..... 02 01021

(51) Int. Cl.
*G06Q 99/00* (2006.01)

(52) U.S. Cl. ..... 705/401; 705/404; 705/406; 705/408

(58) Field of Classification Search ..... 705/404, 705/406, 408, 410, 401, 405
See application file for complete search history.

(56) References Cited

U.S. PATENT DOCUMENTS

| | | | | |
|---|---|---|---|---|
| 5,826,247 | A | 10/1998 | Pintsov et al. | |
| 6,101,487 | A | 8/2000 | Yeung | |
| 6,483,446 | B1 * | 11/2002 | Beach et al. | 341/67 |
| 6,549,892 | B1 * | 4/2003 | Sansone | 705/401 |
| 6,557,755 | B1 * | 5/2003 | Pickering et al. | 235/376 |
| 2002/0029153 | A1 * | 3/2002 | Lee et al. | 705/1 |
| 2002/0078379 | A1 * | 6/2002 | Edwards et al. | 713/201 |
| 2002/0130065 | A1 * | 9/2002 | Bloom | 209/630 |
| 2002/0165835 | A1 * | 11/2002 | Igval | 705/401 |

FOREIGN PATENT DOCUMENTS

| | | |
|---|---|---|
| EP | 0 710 930 | 5/1996 |
| EP | 0 741 374 | 11/1996 |
| EP | 1 017 020 | 7/2000 |
| WO | 01 99056 | 12/2000 |

* cited by examiner

*Primary Examiner* — Akiba K Robinson Boyce
(74) *Attorney, Agent, or Firm* — Sughrue Mion, PLLC

(57) ABSTRACT

This invention relates to a machine for franking mail items, comprising means for printing postal indicia on a mail item and means for also printing on this mail item a unique identification number for this mail item, means for creating at least one data document or file associated with this unique identification number printed on the mail item and means for communicating, through a secure link, the or each data document or file to an information server remote from the franking machine.

16 Claims, 2 Drawing Sheets

SYSTEM FOR FRANKING MAIL ITEMS WITH DATA DOCUMENT OR FILE ASSOCIATED THEREWITH

FIELD OF THE INVENTION

The present invention relates to the domain of mail handling and more particularly to a franking machine making it possible to increase to a very large number the data, postal or not, printed on a mail item.

BACKGROUND OF THE INVENTION

Conventionally, postal indicia being a monetary value, the quality of print thereof on the mail items is primordial in order to avoid any fraud or financial loss for the user in the event of rejection of the franking. Now, such quality of print is associated in particular with the number of printed data, the print of a very large number of data, possibly with complex graphic symbols, being such as to create a degradation of the print and therefore of the legibility of the postal indicia. Unfortunately, Postal Services require at the present time that more and more data, postal or not, be printed on the mail items, relative not only to the dispatch and sorting of these mail items but also to their follow-up, their valorization or securing, and this phenomenon can only amplify, as the Postal Services are regularly proposing new value added postal services.

It is known to resort to the printing of marking in two dimensions (2D bar codes) in order to increase the density of the information printed on the mail items. However, reading of such complex markings is problematic, particularly at high speed. It has also been proposed to replace the postal indicia by an electronic label stuck on the mail item integrating the postal data of this printed impression. Unfortunately, this type of mark, which, moreover, involves high manufacturing costs, requires specific coding and reading means which are not yet wide-spread among consumers and in the Postal Services.

There is therefore a need, heretofore unsatisfied, for a mail handling system allowing a substantial increase in the information present in postal indicia while conserving the quality of print thereof.

It is therefore an object of the present invention to overcome the drawbacks set forth hereinabove.

SUMMARY OF THE INVENTION

To that end, the present invention proposes a machine for franking mail items, comprising means for printing postal indicia on a mail item and means for also printing on this mail item a unique identification number for this mail item, characterized in that it further comprises means for creating at least one data document or file associated with this unique identification number printed on the mail item and means for communicating, through a secure link, said at least one data document or file to an information server remote from the franking machine.

In this way, with the present invention, the postal indicia directly printed by the franking machine (i.e. a machine of closed type integrating secured means for printing the postal indicia) may be limited to their essential elements (date, issuing office, amount and machine number), thereafter allowing a rapid visual check by an agent of the Postal Service when deposited at that Administration, all the other elements, particularly the code of authentification of the indicia and all service markings, being able to be transmitted with the file associated with the unique identification code figuring on the mail item with the postal indicia.

The data document or file comprises postal data and information relative to one or more services requested by the user of the franking machine and advantageously secured information allowing an authentification by said remote information server (preferably a computer-related server of the franking machine agent) of the postal data and other information contained in said data document or file. The information relative to one or more services requested by the user of the franking machine are advantageously accessible from a server of the Postal Service connected to the remote information server by another secured link.

The unique identification number is a series of machine-legible alphanumerical characters, preferably of OCR type or one-dimensional bar code.

The present invention also relates to the process for franking mail items in which postal indicia are printed on a mail item and a unique identification number for this mail item is printed on this mail item, characterized in that at least one data document or file, associated with this unique identification number printed on the mail item is created, and said at least one data document or file is communicated, through a secured link, to an information server remote from the franking machine.

The secured communication of said at least one data document or file from the franking machine to the remote information server is effected periodically, preferably daily.

The unique identification number is preferably obtained from a numbered combination of postal data.

BRIEF DESCRIPTION OF THE DRAWINGS

The invention will be more readily understood on reading the following description given by way of non-limiting example, with reference to the accompanying drawings, in which.

DESCRIPTION OF PREFERRED EMBODIMENT

Figure 1:
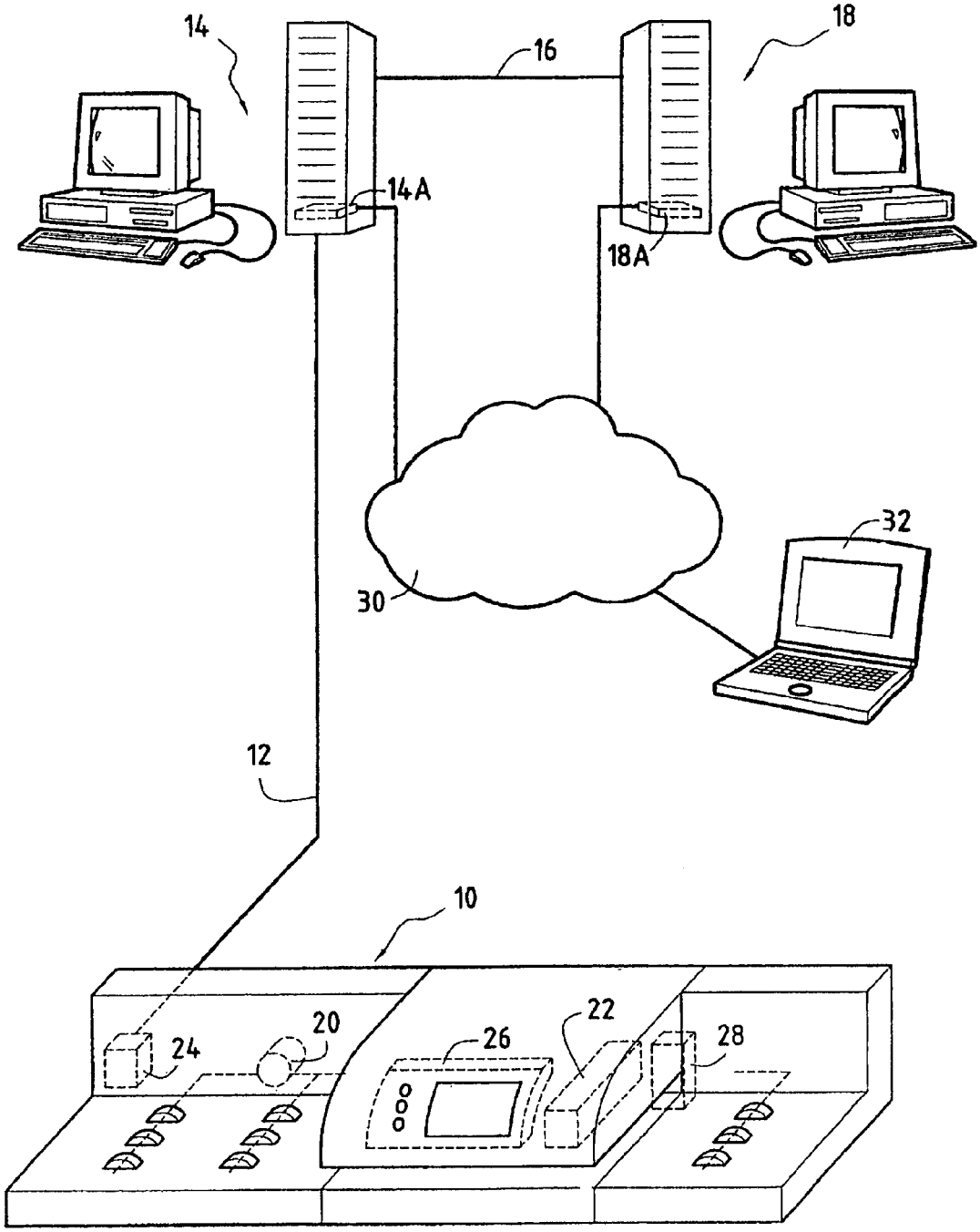
FIG. 1 shows an example of architecture of a mail handling system.

Referring now to the drawings, FIG. 1 schematically illustrates the architecture of a system for handling mail items in which the present invention may be implemented. The term mail item is understood to mean not only an envelope (of any format) but also a label intended to be stuck thereafter on a thick envelope or a packet.

This mail handling system conventionally comprises a mail item franking machine 10 connected, via a first specialized line 12, to a computer-related server 14 of the agent of this machine, this information server itself being connected by a second specialized line 16 to a computer-related server 18 of the Postal Service. The specialized lines 12, 16 are, conventionally, communication lines secured by coding or signature.

The mail item franking machine is a communicating machine of conventional design, of closed type (i.e. integrating secured means for printing the postal indicia) and does not need to be described in detail. It should merely be noted, in order better to understand the invention, that it comprises, among other known means (the following list not being limiting): means 20 for conveying the mail items from a mail item feed module to a reception module; secured means 22 for printing postal indicia, disposed on the path of travel of these mail items; means 24 (of modem type) for interface with the first specialized line 12; means 26 for interface with the user, of the screen and keyboard type for example; and processing means 28 (more particularly incorporating memory and microprocessor) for controlling and monitoring the management of the franking machine.

The agent's server 14 and the Postal Service server 18 are conventional computer-related servers, the former comprising specific but conventional software means allowing the operations of remote maintenance and remote purchases, the monitoring of the franking operations and the possible reloading of a postal credit, and the latter specific, likewise conventional software means for the authorization of installation, the verification of the coding data, the multi-account management and management of the client's postal account, and statistical control.

According to the invention, these two servers further comprise complementary means 14A, 18A for interface with an open communications network of Internet type 30. In effect, these two computer-related servers are each also connected, through this communications network, to at least one data-processing assembly 32, of the conventional personal computer type comprising software means (essentially a navigator) allowing for its owner (user of the franking machine or agent of the Postal Service) access to the Internet network 30 and therefore a consultation of the Internet site of the franking machine agent or of that of the Postal Service.

In effect, in order to increase the quantity of information available in postal indicia printed on a mail item while preserving its legibility, it is proposed to add to such postal indicia a data document or file and to print on the mail item a unique identification number, preferably coded, corresponding to this specific document attached to the postal indicia.

Figure 2:
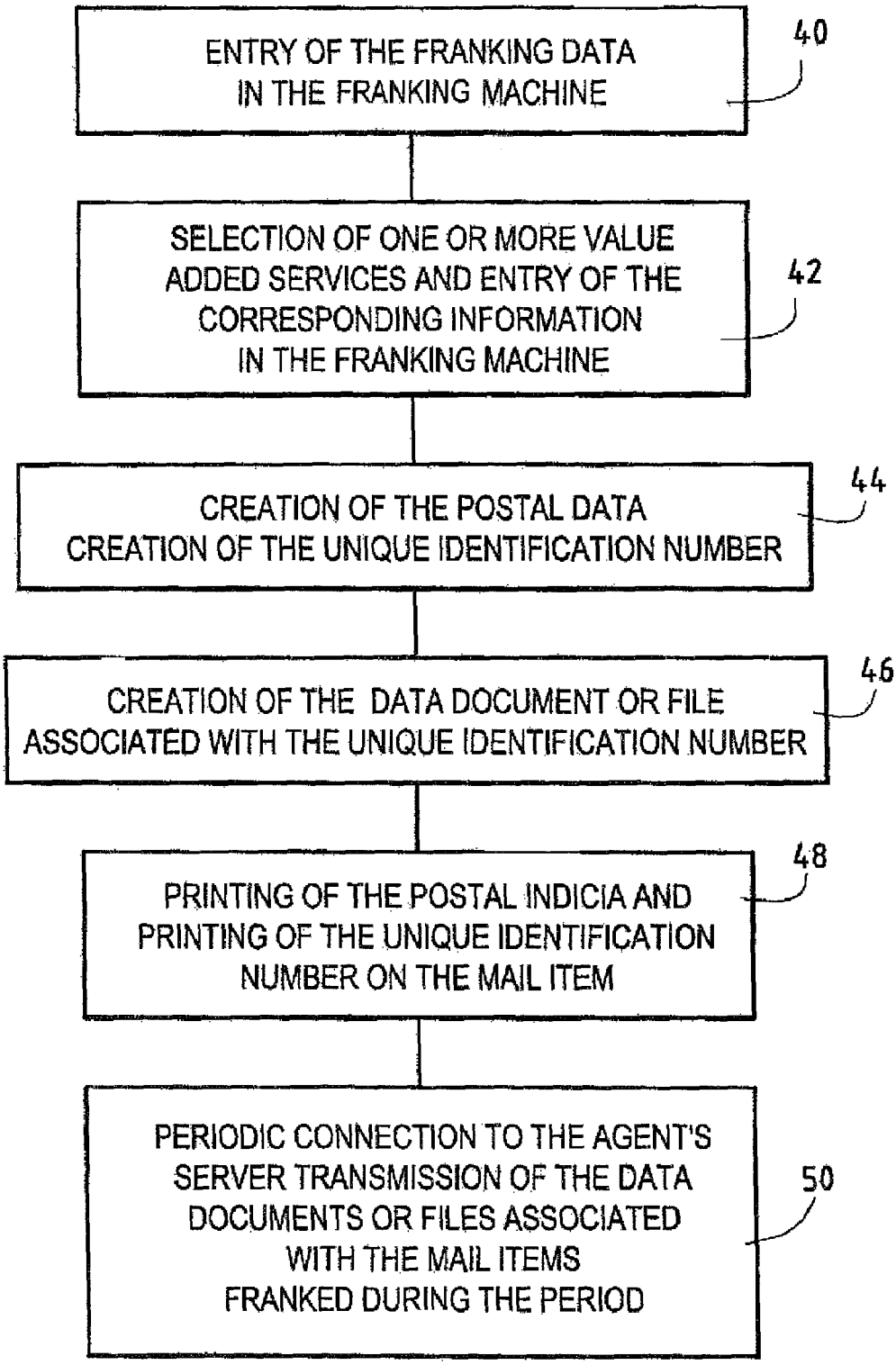
FIG. 2 is a flowchart illustrating the different steps of functioning of the system of FIG. 1.

As illustrated in FIG. 2, the conventional franking data (weight, amount, etc.) are entered via the keyboard of the franking machine (step 40), then the user selects the service or services that it desires in order to send a given mail item (step 42). From these elements, the processing means 28 of this machine will conventionally create (step 44) the postal data but also the unique identification number which is advantageously obtained from certain of these postal data relative to the mail item sent, typically a concatenated combination of the postal number of the franking machine, the amount and date of franking, the number of establishment of deposit, and the sequential number of item for example, without these data being limiting. (In effect, it is possible to add thereto elements of the addressee's address or the number of a service associated with this mail item, or non-postal data). A coding, of the triple DES type for example, carrying out a process of hashing, guarantees for this unique identification number sufficient confidentiality from a possibly decoding. This identification number will then be printed (step 48) with the postal indicia, in this postal indicia or near it, in the form of numerical or alphanumerical characters, preferably readable by an OCR reader, or in the form of a one-dimensional (1D) bar code readable with a conventional bar code reader.

Previously or concomitantly, the data document or file associated with determined postal indicia is created (step 46) by the processing means 28 of the franking machine and stored in its memory means with the other postal data necessary for printing the postal indicia. Of course, it comprises all the usual legend of the postal indicia (amount and date of franking, postal number of the franking machine, name and number of establishment of deposit, sequential number of item, etc.) necessary for a visual check by the agents of the Postal Service as to the apparent validity of the mail item but, also and especially, all the other data useful for processing (reception, follow-up, remittance) of the mail item by the Postal Service, in particular all information relative to one or more services requested by the user (registered mail, mention of the carrier, etc.) relative to this mail item and of which the legend on the mail item is in that case no longer necessary. Of course, this document or file will also include security information allowing an authentification by the agent's server 14 of the postal data and other information contained in the data document.

With the present invention, the problem of the legibility of the postal indicia (due to the presence of too great an amount of information), or of the limitation of the information able to be printed on the mail item (to guarantee a 100% legibility by the Postal Service) is solved, since such information is no longer intended to be printed on the mail item but stored in a document or file in the franking machine and the only limit to the information that may be stored in this file associated with the postal indicia is that of the size of the memory means of the franking machine. It will also be noted that the invention lends itself particularly well to the upgrading of existing machines for which it will simply suffice to increase the memory means and implant complementary software means adapted to the new functionalities.

The service information and other value added information (for example the registered nature of the mail item) no longer being printed on the mail item, it can be known by the Postal Service only after reading the unique identification number printed on this mail item and giving access to the associated data file. This is why, the franking machine 10 being a connected machine, i.e. having a communication link via its modem interface 24 with the agent's server 14, the franking machine proceeds periodically, preferably once a day (possibly after several successive attempts in the event of failure of communication), with a connection to this server and with a coded exchange of information between them in which there are transmitted, apart from the usual monitoring data (machine number and contents of the ascending/descending registers), the different files associated with each of the mail items franked during the period of reading in question (final step 50). This coded exchange conventionally includes security information necessary for the authentification and non-repudiation of the message. Such data after verification will be retransmitted (after a fresh coding) towards the Postal Service's server 18 where it will be accessible to the agents of the Postal Service, part of it being rendered accessible on the Internet site of the franking machine agent and that of the Postal Service.

In this way, when a mail item is received in a receiving office of the Postal Service, the unique identification number is automatically captured (by an OCR or bar code reading device depending on the type of printing employed), and possibly decoded if it is coded, which gives access to the file number associated with the mail item and, via the Postal Service server in liaison with the reading devices of the receiving offices, to the data contained in this file. The Postal Service agent may then proceed with processing this mail item depending on the services requested by the user-sender, and possibly return to the Postal Service server, via suitable capture means such as a capture at the Internet site of the Postal Service, different follow-up information relative to the mail item processed.

Similarly, when the user connects to the Internet site of the agent of its franking machine via any data-processing assembly 32 connected to the Internet network 30 (for example a personal computer or a PDA telephone) and accesses its personal account with this agent (after entry of a user name and a password), it may visualize the information transmitted by its franking machine as well as that relative to the follow-up of its mail previously updated by the Postal Service. It will be noted that, if such a consultation by Internet proves very practical (in particular as it is possible from any point of the globe), it is, of course, possible to envisage this consultation by telephone or by a service of teletel or audiotel type.

What is claimed is:

1. A machine for franking mail items, comprising:

means for printing postal indicia on a mail item and means for also creating a unique identification number for the mail item, the means for printing postal indicia also printing the unique identification number on the mail item, where the unique identification number is not a postal code already used by a postal service, and means, provided in the franking machine, for creating at least one data document or file associated with the unique identification number printed on the mail item and means for communicating, through a secure link, said at least one data document or file to an information server remote from the franking machine, wherein the unique identification number is printed on the mail item instead of postal codes used by the postal service that are not necessary to verify the validity of the mail item, such that a total amount of data printed on the mail item is reduced.

2. The franking machine of claim 1, wherein said at least one data document or file comprises postal data and information relative to one or more services requested by a user of the franking machine.

3. The franking machine of claim 1, wherein said at least one data document or file further comprises security information allowing an authentication by said remote information server of the postal data and information relative to one or more services requested by a user of the franking machine, which are contained in said at least one data document or file.

4. The franking machine of claim 1, wherein said unique identification number is a series of machine-readable alphanumerical characters of OCR or one-dimensioned bar code type.

5. The franking machine of claim 1, wherein said remote information server is a computer-related server of the franking machine.

6. A process for franking mail items in a franking machine, comprising:

printing postal indicia on a mail item;

creating a unique identification number for the mail item; and printing the unique identification number on the mail item, where the unique identification number is not a postal code already used by a postal service, wherein at least one data document or file, associated with the unique identification number is further created in the franking machine, and said at least one data document or file is communicated, through a secured link, to an information server remote from the franking machine, and wherein the unique identification number is printed on the mail item instead of postal codes used by the postal service that are not necessary to verify the validity of the mail item, such that a total amount of data printed on the mail item is reduced.

7. The process of claim 6, wherein the secured communication of said at least one data document or file from the franking machine to the remote information server is effected periodically.

8. The process of claim 6, wherein said at least one data document or file comprises postal data, information relative to one or more services requested by the user of the franking machine, and security information allowing an authentication by said remote information server of the postal data and information relative to one or more services requested by a user of the franking machine, which are contained in said at least one data document or file.

9. The process of claim 8, wherein said information relative to one or more services requested by the user of the franking machine is accessible from a Postal Service server connected to the remote information server by another secured link.

10. The process of claim 6, wherein said unique identification number is obtained from a coded combination of postal data.

11. The process of claim 6, wherein the secured communication of said at least one data document or file from the franking machine to the remote information server is effected daily.

12. A machine for franking mail items, comprising:

means for printing postal indicia on a mail item and means for also creating a unique identification number for the mail item, the means for printing postal indicia also printing the unique identification number on the mail item, where the unique identification number is provided instead of all other postal codes including service codes, and means, provided in the franking machine, for creating at least one data document or file associated with the unique identification number printed on the mail item and means for communicating, through a secure link, said at least one data document or file to an information server remote from the franking machine.

13. The franking machine of claim 12, wherein said at least one data document or file comprises postal data and information relative to one or more services requested by a user of the franking machine.

14. The franking machine of claim 12, wherein said at least one data document or file further comprises security information allowing an authentication by said remote information server of the postal data and information relative to one or more services requested by a user of the franking machine, which are contained in said at least one data document or file.

15. The franking machine of claim 12, wherein said unique identification number is a series of machine-readable alphanumerical characters of OCR or one-dimensioned bar code type.

16. The franking machine of claim 12, wherein said remote information server is a computer-related server of the franking machine.

* * * * *